US005176252A

United States Patent [19]

Davis

[11] Patent Number: 5,176,252

[45] Date of Patent: Jan. 5, 1993

[54] CONTAINER FOR GARMENT HANGERS

[76] Inventor: Eddie R. Davis, P.O. Box 1479, Morristown, Tenn. 37816-1479

[21] Appl. No.: 795,236

[22] Filed: Nov. 15, 1991

Related U.S. Application Data

[63] Continuation of Ser. No. 663,789, Mar. 4, 1991, abandoned, which is a continuation of Ser. No. 409,813, Sep. 20, 1989, abandoned.

[51] Int. Cl.[5] ..... B65D 83/00

[52] U.S. Cl. ..... 206/300; 211/59.2

[58] Field of Search ..... 206/300; 211/13, 59.2; 223/122, 122.1

[56] References Cited

U.S. PATENT DOCUMENTS

| | | | |
|---|---|---|---|
| 1,591,087 | 7/1926 | Holliday | 206/300 |
| 2,609,919 | 9/1952 | Lee | 206/300 |
| 3,115,968 | 12/1963 | Peterson | 206/300 |
| 3,157,343 | 11/1964 | Kendall | 206/300 |
| 3,684,128 | 8/1972 | Crisafi | 229/122 |
| 3,987,898 | 10/1976 | Crane | 206/300 |
| 4,566,607 | 1/1986 | Smith | 229/122.1 |
| 4,711,383 | 12/1987 | Jenkins | 206/300 |

*Primary Examiner*—Jimmy G. Foster

[57] ABSTRACT

A container for garment hangers comprising a rigid substantially closed container having a horizontal slot in the upper front end adapted to receive garment hangers and a vertical slot in the front end intersecting with the horizontal slot. Garment hangers are inserted into the container and the necks of such hangers extend through the vertical slot outside of the container. Garment hangers inserted into the hanger container are stored in an orderly manner, and such hangers can be easily removed thereafter for use.

2 Claims, 2 Drawing Sheets

CONTAINER FOR GARMENT HANGERS

This is a continuation of copending application Ser. No. 663,789, filed Mar. 4, 1991, now abandoned, which is a continuation of copending application Ser. No. 409,813, filed Sep. 20, 1989 now abandoned.

TECHNICAL FIELD

The present invention relates generally to a garment hanger container for inserting garment hangers, and more particularly to a container for storing and maintaining garment hangers in an orderly fashion. The container allows the stored hangers to be used in the home, laundries, stores and the like. The container prevents entanglement of the stored hangers with each other so that individual garment hangers can be easily withdrawn from the container for use when needed.

BACKGROUND ART

Garment hangers, especially wire hangers, are bulky, are unusally shaped and present an entanglement problem when being stored. This is particularly true when the hangers are not stored in a hanging position. Such hangers when collected in a box or other similar storage containers generally become entangled and before being used usually require that the entangled hangers must be separated and maintained in a separated state before an individual hanger can be used. This necessitates generally that an individual has to use both hands to extract a single hanger from the container in which such hangers are being stored.

Heretofore, this entanglement problem has been recognized in the prior art and several different containers have been proposed to solve this problem. These prior art containers maintain the hangers, such as wire hangers, so that individual hangers can be easily removed conveniently and separately for use when needed, for example, in a home laundry.

Once such prior art container is shown in U.S. Pat. No. 3,987,898 which issued to W. B. Crane on Oct. 26, 1976 disclosing an open-ended container for depositing garment hangers. However, the garment stacking container is large and cumbersome and not generally useful in a home environment. Another solution offered by the prior art to solve this hanger storage problem is shown in U.S. Pat. No. 4,711,383 which issued to James E. Jenkins on Dec. 8, 1987 disclosing a clothes hanger carrier and storage container. This container is similar to the Crane container noted hereinbefore but of a smaller size and can easily be carried by a housewife, when preparing to do home laundry. One of the problems with both of these containers is that each of them is open at the top. Should the container be dropped or turned over, the hangers positioned therein could easily fall out of the containers and thereby become entangled.

Another solution offered by the prior art to solve this storage entanglement problem is shown in U.S. Pat. No. 4,722,438 issuing to Rexford L. Hicks on Feb. 2, 1988 disclosing an organizer container for garment hangers. This Hicks container allows vertical storage of hangers and maintains the hangers separately between ribbed sections of the container. This container likewise is open at its upper portion, and has some of the deficiencies of the other prior art containers. Therefore, it would be an advance in the art to provide a substantially closed container for garment hangers which would allow the hangers to be inserted into the container, stored and safely retained irrespective of the positing of the container in an unentangled state and subsequently easily removed for use when needed.

DISCLOSURE OF THE INVENTION

In accordance with the present invention, there is provided a container for garments which is a substantially closed container, which may be of a unitary construction, having front, back, top, bottom and at least one side wall. The front of the container has defined therein a horizontal slot formed in the upper portion thereof and a vertical slot formed in the center thereof, said horizontal and vertical slots communicating with each other in the center of the horizontal slot. The garment hangers are inserted into the container through the horizontal slot with the neck portion of the garment hanger remaining outside of the container. In a resting position the neck portion of the garment hanger extends outside of the vertical slot formed in the container. The horizontal and vertical slots formed in the container are of such width to receive garment hangers deposited in the container. The container enables garment hangers of various sizes to be inserted into the container and subsequently removed from the container for use. The container enables garment hangers to be collected, stored and subsequently used in a convenient manner. Such container can be used for example in a home, store, laundry or the like where garment hangers are removed from clothing. The garment hangers can be inserted into the container and when needed, as for example on laundry day, taken to the laundry room and removed in an untangled and orderly fashion for reuse in placing garments on such garment hangers. The container can be used, for example, by placing the container on a shelf or in a laundry basket, or suitable means can be added to the container for hanging the container in a closet, and the like. One advantage of the container is, of course, that if the container is placed upside down when in use the garment hangers will not spill out and become entangled.

Accordingly, it is an object of the present invention to provide a container into which garment hangers can be placed for storage in a manner whereby such stored garment hangers can be individually removed when desired.

Another object of this invention is to provide a container into which garment hangers can be inserted for storage in an untangled order and then readily individually removed for use as desired.

It is still another object of the invention to provide a substantially closed container that can receive garment hangers and safely retain such garment hangers irregardless of the position of the container.

These and other objects of the invention will become apparent upon a consideration of the drawings and the description which follows.

DETAILED DESCRIPTION OF THE INVENTION

Figure 4:
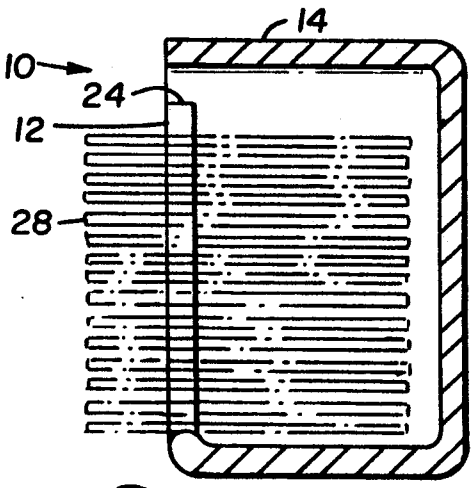
FIG. 4 is a cross-sectional view of the embodiment of FIG. 2 taken along line 4—4 thereof.
Figure 1:
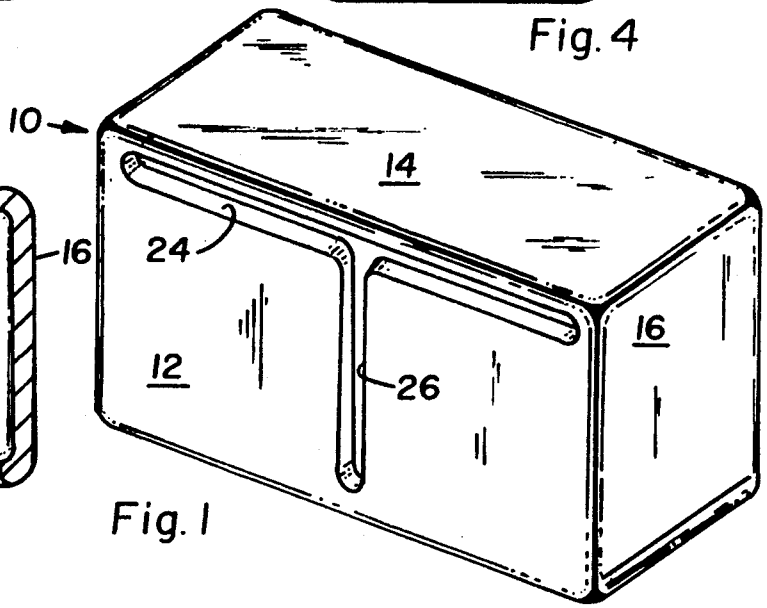
FIG. 1 is an isometric view of one embodiment of the present invention.
Figure 2:
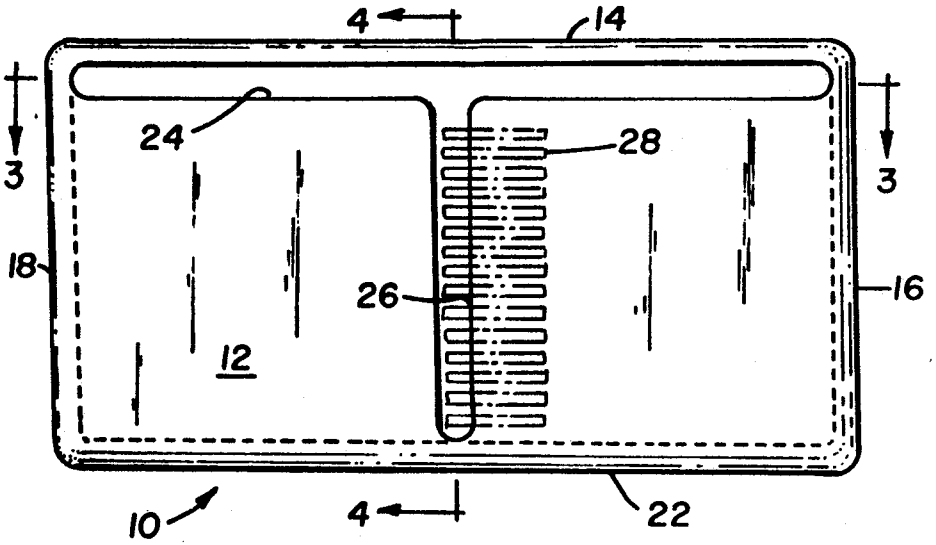
FIG. 2 is a front elevational view of FIG. 1.
Figure 3:
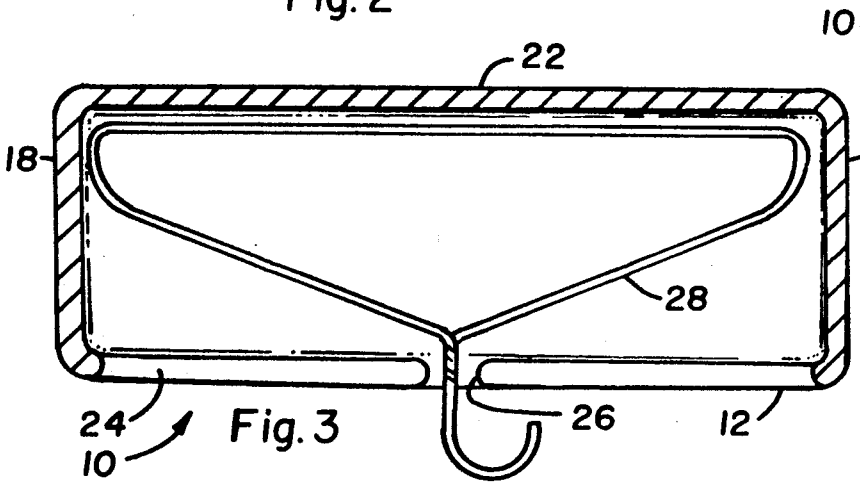
FIG. 3 is a cross-sectional view of the embodiment of FIG. 2 taken along line 3—3 thereof.
Figure 8:
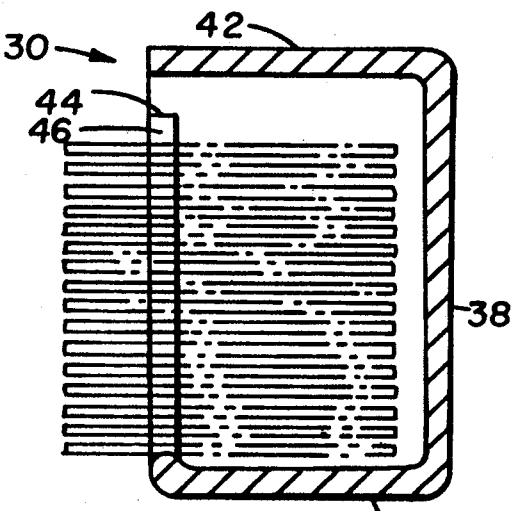
FIG. 8 is a cross-sectioned view of the embodiment of FIG. 6 taken along line 8—8 thereof.
Figure 5:
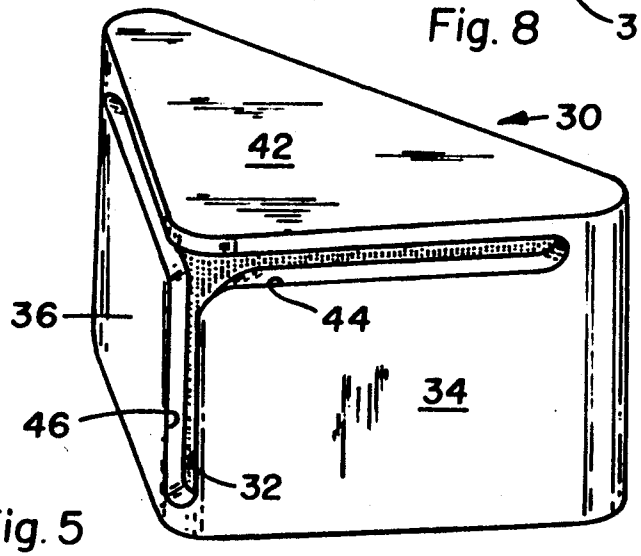
FIG. 5 is an isometric view of another embodiment of the present invention.
Figure 6:
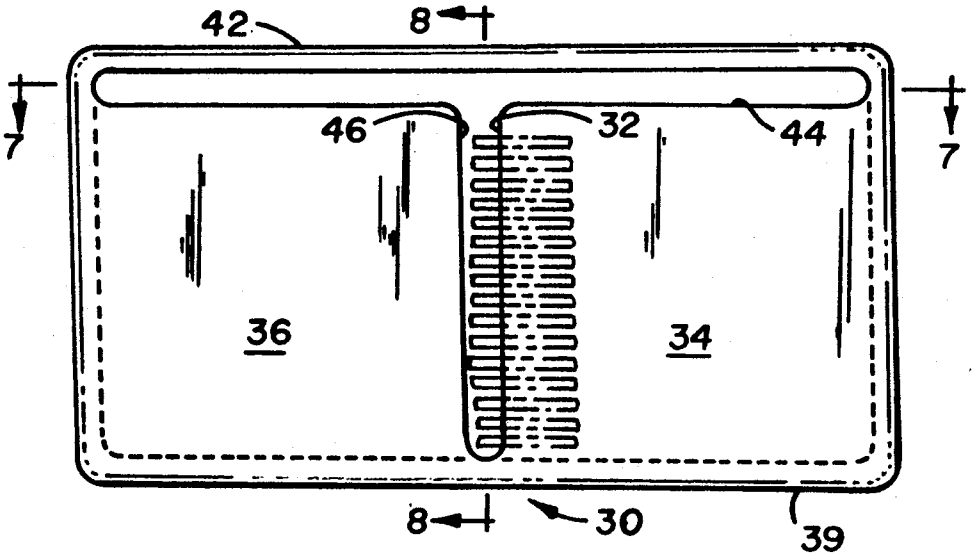
FIG. 6 is a front elevational view of FIG. 5.
Figure 7:
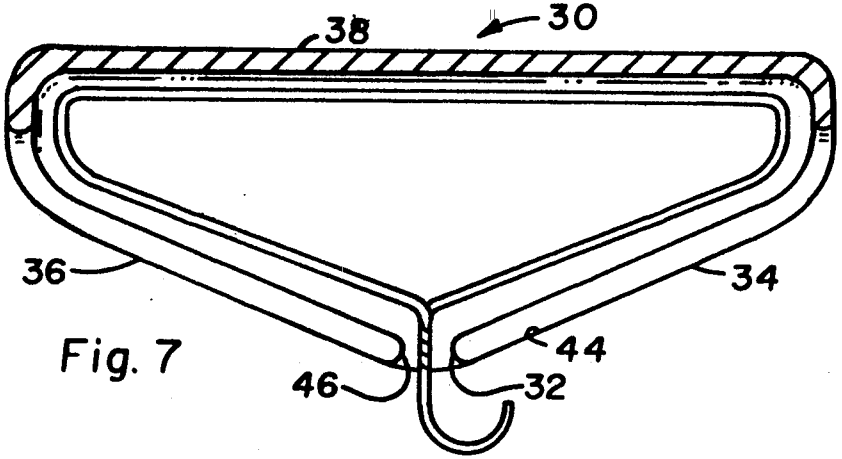
FIG. 7 is a cross-sectional view of the embodiment of FIG. 6 taken along line 7—7 thereof.

The container for garment hangers of the present invention can be best described with reference to FIGS. 1, 2, 3, and 4. The container shown at 10 in FIG. 1, is of generally rectangular configuration, preferably integrally formed in one piece. The container illustrated has a front wall 12, a top wall 14, side walls 16 and 18, and a bottom wall 22. The front wall 12 has defined therein a horizontal slot 24 formed in the upper portion thereof and a vertical slot 26 formed in the center thereof. The horizontal slot 24 formed in front wall 12 of container 10 has a length and width sufficient to enable garment hanger 28 to be inserted therein. The vertical slot 26 formed in front wall 12 is substantially the height of the front wall and at its upper portion it communicates with horizontal slot 24. The vertical slot 26 also has a width sufficient to receive the neck portion of a garment hanger 28 inserted into horizontal slot 24, thereby enabling the neck portion of garment hangers inserted into horizontal slot 24 to extend outside of vertical slot 26 from container 10, and the remainder of the garment hanger to be stored within container 10.

The container for garment hangers of another embodiment of the present invention can best be described with reference to FIGS. 5, 6 and 7, and 8. The container shown at 30 has a substantially triangular configuration. The illustrated container has a front wall or apex 32, side walls 34 and 36, back wall 38, bottom wall 39 and top wall 42. The front wall 32 of the triangular configuration and the side walls 34 and 36 have defined therein horizontal slot 44 formed in the upper portion thereof and a vertical slot 46 in the front wall thereof. The horizontal slot 44 formed in the front wall 32 and side walls 34 and 36 has a width sufficient to enable garment hanger 48 to be inserted therein. The vertical slot 46 formed in the front wall 31 is substantially the height of front wall 31 and at its upper portion it communicates with horizontal slot 44. The vertical slot 46 also has a width sufficient to receive the neck portion of a garment hanger 48 inserted into horizontal slot 44, thereby enabling the neck portion of garment hanger 48 inserted into horizontal slot 44 to extend outside of vertical slot 46 from container 30, and the remainder of the garment hanger 48 to be stored within container 30.

The container for garment hangers can be placed on shelves, floor or any desired location, as for example, in a clothes closet or other area. As a garment is removed from a garment hanger in a garment storage area, the garment hanger may be inserted in the container. After being collected and stored in the container, the container can be transported or carried to a laundry facility. This laundry facility can be a home laundry or a commercial do-it-yourself laundry. The closed feature of the present container prevents the hangers from spilling out of the container should the container be dropped or turned over.

The container of the present invention can be fabricated, for example, of any suitable plastic, wood, fiber board and the like. The container can be suitably molded in one piece.

Also, the top, bottom, front, back and side walls can be separately formed and then assembled to form a rectangular, square or trapezoidal shaped container.

From the foregoing it is apparent that a practical container for garment hangers has been disclosed. The unit depicted in each of the embodiments in FIGS. 1–5 is shaped and sized primarily for use in a home. However, it should be apparent that containers of other sizes and shapes may be made for use in laundries, dry cleaning establishments, department stores and the like where garment hangers are stored in bulk or in large numbers for future use.

Also, it shall be apparent that the size and shape of the garment hanger container is a matter of the user specific desires of use. The container can be rectangular, square, triangular, round and the like.

The invention has been described in detail with particular reference to preferred embodiments thereof, but it will be understood that variations and modifications can be made within the spirit and scope of the invention.

I claim:

1. A container for garment hangers comprising a rigid substantially closed container, said container having a substantially triangular configuration and having front and side walls defining a horizontal slot extending through the upper portion thereof, and said front wall also defining a vertical slot extending centrally therethrough, wherein said vertical slot intersects intermediately of said horizontal slot, said horizontal and vertical slots being adapted to receive garment hangers inserted through said horizontal slot having the neck portions of said garment hangers extending outside of said container through said vertical slot to maintain said hangers in a stored and untangled state.

2. A container for garment hangers comprising a rigid substantially closed container, said container having a front wall, back wall, top wall, bottom wall and at least one side wall, at least one of said walls defining a horizontal slot extending through the upper portion thereof, and said front wall defining a vertical slot extending centrally therethrough, wherein said vertical slot intersects intermediately of said horizontal slot, said horizontal and vertical slots being adapted to receive garment hangers inserted through said horizontal slot having the neck portions portions of said garment hangers extending outside of said container through said vertical slot to maintain said garment hangers in a stored and untangled state, and wherein said container has at least one garment hanger positioned within said container.

* * * * *